US007751739B2

(12) United States Patent
Endo

(10) Patent No.: US 7,751,739 B2
(45) Date of Patent: Jul. 6, 2010

(54) POWER SUPPLY CONTROL OF AN IMAGE FORMING APPARATUS

(75) Inventor: Katsuya Endo, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 654 days.

(21) Appl. No.: 11/688,516

(22) Filed: Mar. 20, 2007

(65) Prior Publication Data

US 2008/0232837 A1 Sep. 25, 2008

(51) Int. Cl.
*G03G 15/16* (2006.01)

(52) U.S. Cl. ..... 399/66; 399/50; 399/302; 399/310

(58) Field of Classification Search ..... 399/37, 399/88

See application file for complete search history.

(56) References Cited

U.S. PATENT DOCUMENTS

2001/0031160 A1* 10/2001 Tanaka ..... 399/298
2005/0013636 A1* 1/2005 Sawai et al. ..... 399/302

FOREIGN PATENT DOCUMENTS

JP 2003-079139 3/2003

* cited by examiner

*Primary Examiner*—David M Gray
*Assistant Examiner*—Roy Yi
(74) *Attorney, Agent, or Firm*—Turocy & Watson, LLP

(57) ABSTRACT

A level determination circuit 60 determines whether a voltage level Vref of an output variable signal is a previously set reference level Vref−m or higher. According to this determination result, a constant voltage output circuit 70 and a constant current output circuit 80 selectively operate. The constant voltage output circuit 70 outputs a transfer voltage Vout of a level corresponding to the voltage level Vref of the output variable signal. The constant current output circuit 80 outputs a constant current Iout of a level corresponding to the voltage level Vref of the output variable signal.

18 Claims, 3 Drawing Sheets

POWER SUPPLY CONTROL OF AN IMAGE FORMING APPARATUS

BACKGROUND OF THE INVENTION

1. Field of the Invention

The present invention relates to an image forming apparatus including a process unit and at least one power supply unit to output voltage and current required for the operation of the process unit.

2. Description of the Related Art

An image forming apparatus, for example, a color copier includes a process unit having, as an image bearing body, a photoconductive drum and an intermediate transfer belt.

The process unit includes at least one power supply unit (so-called high voltage power supply unit) to output voltage and current required for the operation of the process unit.

Besides, the process unit includes a charging unit to charge the surface of the photoconductive drum, a laser unit to expose the surface of the photoconductive drum charged by the charging unit to a laser beam and to form an electrostatic latent image on the surface of the photoconductive drum, a development unit to supply a toner to the surface of the photoconductive drum and to develop the electrostatic latent image on the surface of the photoconductive drum into a visible image, a primary transfer roller to transfer the visible image on the photoconductive drum to the intermediate transfer belt, a secondary transfer roller to transfer the visible image on the intermediate transfer belt to a paper sheet, and the like.

The power supply unit includes a constant voltage output circuit to output a transfer voltage of the primary transfer roller, and a constant current circuit to output a constant current to measure the impedance of the intermediate transfer belt before transfer by the primary transfer roller. The impedance of the intermediate transfer belt is measured based on the constant current outputted from the constant current circuit. The level of the transfer voltage outputted from the constant voltage output circuit is determined according to the measured impedance.

An output variable signal to set the level of the transfer voltage and the level of the constant current is inputted to the power supply unit. The level of the transfer voltage and the level of the constant current are set according to the voltage level of the output variable signal. Further, ON and OFF signals to set ON and OFF of the operation of the constant voltage output circuit and the constant current output circuit are inputted to the power supply unit, and a mode switching signal to cause one of the output of the constant voltage output circuit and the output of the constant current output circuit to be outputted is inputted.

BRIEF SUMMARY OF THE INVENTION

The control of the power supply unit requires the above three signals. Thus, three signal lines are connected to the power supply unit. When the number of signal lines is large, the circuit becomes complicated, and the cost is increased.

An object of an aspect of the invention is to provide an image forming apparatus in which a voltage output and a current output of a power supply unit can be appropriately controlled by only one signal, the number of signal lines can be reduced by this, and the simplification of a circuit and cost reduction can be achieved.

An image forming apparatus of an aspect of the invention includes a process unit having an image bearing body, and at least one power supply unit to output a voltage and a current required for an operation of the process unit, and the power supply unit includes a level determination circuit to determine whether a voltage level of an output variable signal inputted from outside is a previously set reference level or higher, and a constant voltage output circuit and a constant current output circuit selectively operating according to a determination result of the level determination circuit.

The constant voltage output circuit outputs the voltage of a level corresponding to the voltage level of the output variable signal.

The constant current output circuit outputs the current of a level corresponding to the voltage level of the output variable signal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

Hereinafter, an embodiment of the invention will be described with reference to the drawings.

Figure 1:
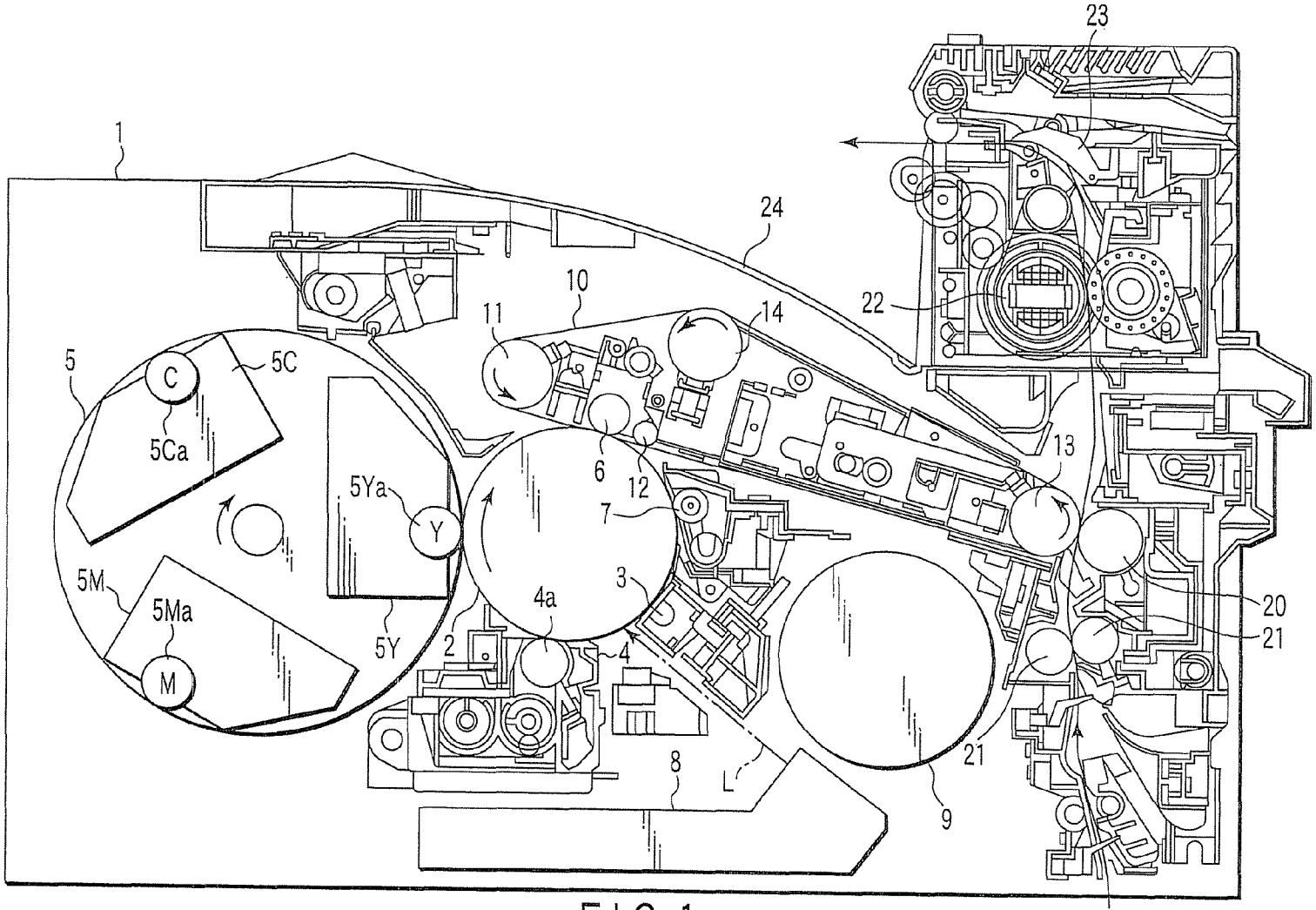
FIG. 1 is a view showing the whole structure of an embodiment.

As shown in FIG. 1, a photoconductive drum (image bearing body) 2 is provided to be rotatable in a clockwise direction in a main body 1 of an image forming apparatus, for example, a digital copier. A charging unit 3, a black development unit 4, a rotary color development unit 5, a primary transfer roller 6, and a cleaning unit 7 are sequentially disposed around the photoconductive drum 2. The charging unit 3 charges the surface of the photoconductive drum 2.

A laser beam L emitted from a laser unit 8 passes through a gap between the charging unit 3 and the black development unit 4 and is irradiated on the surface of the photoconductive drum 2. The surface of the photoconductive drum 2 is exposed by the irradiation of the laser beam L, and an electrostatic latent image is formed on the surface of the photoconductive drum 2.

The black development unit 4 supplies a black (K) toner to the surface of the photoconductive drum 2 by a roller 4*a*. By this supply, the electrostatic latent image on the photoconductive drum 2 is developed into a black visible image. In order to supply the black toner to the black development unit 4, a black toner bottle 9 with a large capacity is prepared.

The rotary color development unit 5 includes a yellow development section 5Y, a magenta development section 5M and a cyan development section 5C, and rotates in the clockwise direction in the vicinity of the photoconductive drum 2. The yellow development section 5Y includes a roller 5Ya which can come in contact with and can be separated from the surface of the photoconductive drum 2, and the roller 5Ya comes in contact with the surface of the photoconductive drum 2 so that a yellow (Y) toner is supplied to the surface of the photoconductive drum 2. The magenta development section 5M includes a roller 5Ma which can come in contact with and can be separated from the surface of the photoconductive drum 2, and the roller 5Ma comes in contact with the surface of the photoconductive drum 2 so that a magenta (M) toner is supplied to the surface of the photoconductive drum 2. The cyan development section 5C includes a roller 5Ca which can come in contact with and can be separated from the surface of the photoconductive drum 2, and the roller 5Ca comes in contact with the surface of the photoconductive drum 2 so that a cyan (C) toner is supplied to the surface of the photoconductive drum 2.

The photoconductive drum 2 makes one rotation or several rotations according to required development colors, and sequentially receives the toners of the respective colors from the black development unit 4 and the rotary color development unit 5. By this, the electrostatic latent image on the photoconductive drum 2 is developed into the visible image of one color or a color in which the four colors are superimposed on each other.

The primary transfer roller 6 applies a constant voltage (high voltage) to the intermediate transfer belt 10 passing between itself and the photoconductive drum 2, and transfers the visible image on the photoconductive drum 2 to the intermediate transfer belt 10. The cleaning unit 7 cleans the surface of the photoconductive drum 2 after completion of the transfer. The toner or the like remaining on the surface of the photoconductive drum 2 is removed by this cleaning.

The intermediate transfer belt 10 is stretched over a drive roller 11, a winding roller 12, a driven roller 13 and a tension roller 14, receives power from the drive roller 11, and rotates in the counterclockwise direction. The winding roller 12 serves to press the intermediate transfer belt 10 to the photoconductive drum 2 side. The tension roller 14 is for adjusting the tension of the intermediate transfer belt 10.

A secondary transfer roller 20 is provided so as to come in contact with the intermediate transfer belt 10 on the driven roller 13. A paper sheet supplied from a paper feed cassette (not shown) to register rollers 21 and 22 is sent to between the intermediate transfer belt 10 and the secondary transfer roller 20 by the register rollers 21 and 21. The secondary transfer roller 20 applies a transfer constant voltage to the paper sheet passing between itself and the intermediate transfer belt 10 and transfers the visible image on the intermediate transfer belt 10 to the paper sheet. The paper sheet after completion of the transfer is sent to a fixing unit 22. The fixing unit 22 fixes the visible image transferred on the paper sheet to the paper sheet by heat. The paper sheet passing through the fixing unit 22 is discharged to a paper discharge tray 24 on the upper surface of the main body 1 through a guide gate 23. Incidentally, the secondary transfer roller 20 comes in contact with the intermediate transfer belt 10 on the driven roller 13 only when the transfer is required, and is separated from the intermediate transfer belt 10 when the transfer is not required.

An after-mentioned process unit 45 is constructed of the photoconductive drum 2, the charging unit 3, the black development unit 4, the rotary color development unit 5, the primary transfer roller 6, the cleaning unit 7, the laser unit 8, the intermediate transfer belt 10, the drive roller 11, the winding roller 12, the driven roller 13, the tension roller 14, the secondary transfer roller 20 and the like.

Figure 2:
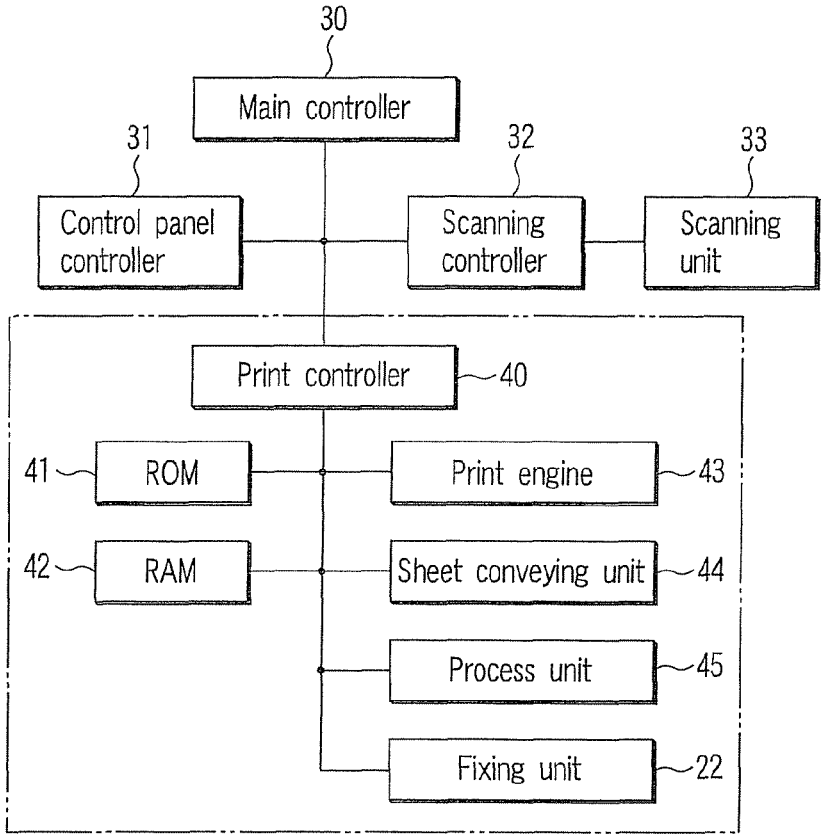
FIG. 2 is a block diagram of a control circuit of the embodiment.

FIG. 2 shows a control circuit.

A main controller 30 is connected with a control panel controller 31, a scanning controller 32, and a print controller 40. The main controller 30 controls the control panel controller 31, the scanning controller 32 and the print controller 40 overall.

A scanning unit 33 for document reading is connected to the scanning controller 32. The print controller 40 is connected with a ROM 41 for control program storage, a RAM 42 for data storage, a print engine 43, a sheet conveying unit 44, a process unit 45 and a fixing unit 22. The print engine 43 is constructed of a drive system of the laser unit 8 and the like. The sheet conveying unit 44 is constructed of a conveying mechanism of a paper sheet, its drive circuit and the like.

Figure 3:
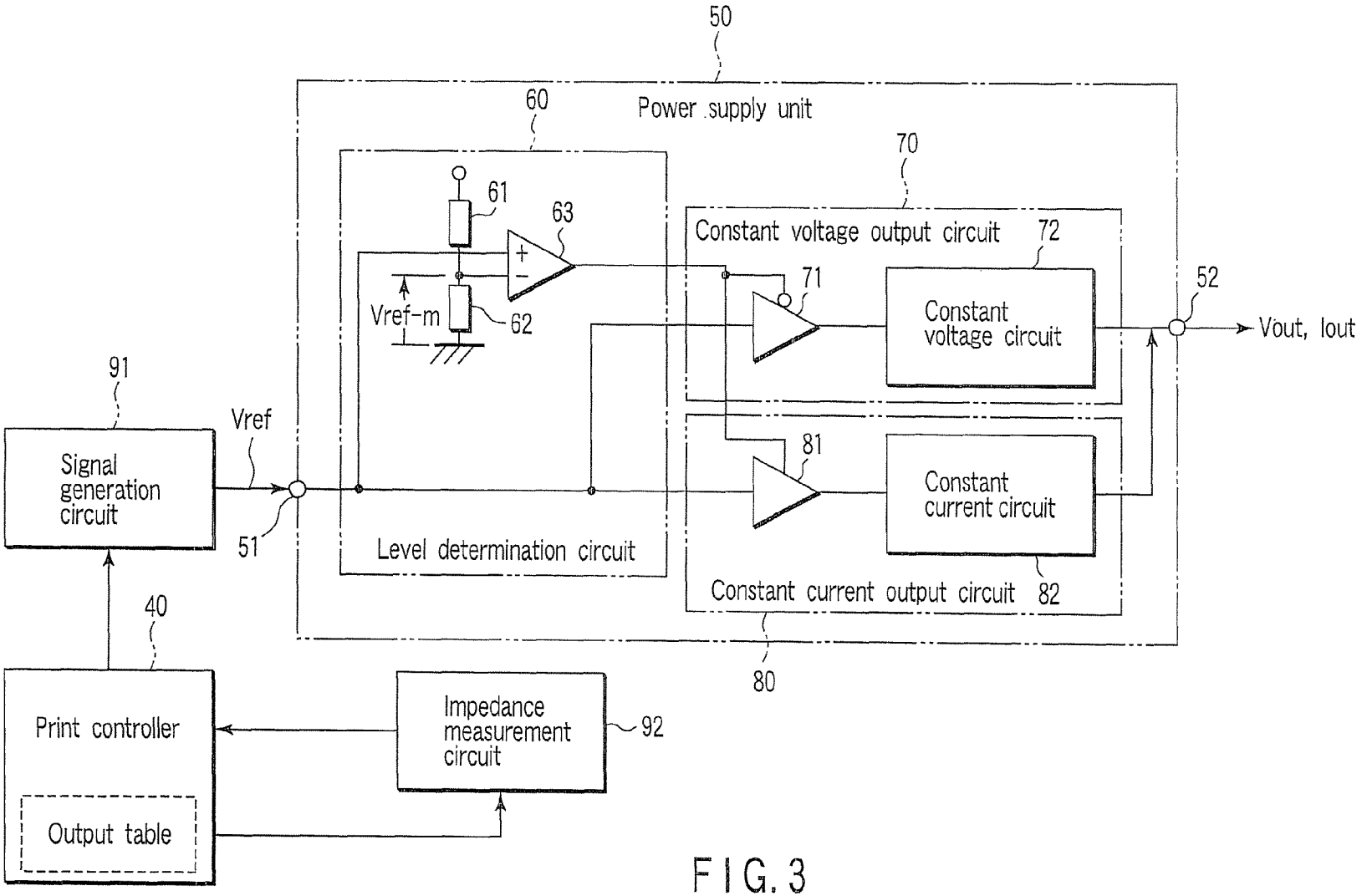
FIG. 3 is a block diagram of a power supply unit of the embodiment.

The process unit 45 includes a power supply unit (so-called high voltage power supply unit) 50 shown in FIG. 3, a signal generation circuit 91 and an impedance measurement circuit 92.

The power supply unit 50 includes an input terminal 51, a level determination circuit 60, a constant voltage output circuit 70, a constant current output circuit 80, and an output terminal 52.

The signal generation circuit 91 outputs an output variable signal of a voltage level Vref according to an instruction from the print controller 40. This output is inputted to the input terminal 51 of the power supply unit 50. The output variable signal inputted to the input terminal 51 is supplied to the level determination circuit 60, the constant voltage output circuit 70, and the constant current output circuit 80.

The level determination circuit 60 includes a series circuit of resistors 61 and 62 and a comparison circuit 63, and determines whether the voltage level Vref of the inputted output variable signal is a previously set reference level Vref−m or higher.

The constant voltage output circuit 70 and the constant current output circuit 80 selectively operate according to the determination result of the level determination circuit 60. That is, the constant voltage output circuit 70 includes a switch circuit 71 and a constant voltage circuit 72, operates when the switch circuit 71 is turned on in a case where the determination result of the level determination circuit 60 is negative, and outputs, as a transfer voltage required for transfer by the primary transfer roller 6, a voltage Vout of a level corresponding to the voltage level Vref of the output variable signal. The constant current output circuit 80 includes a switch circuit 81 and a constant current circuit 82, operates when the switch circuit 81 is turned on in a case where the determination result of the level determination circuit 60 is affirmative, and outputs a constant current Iout of a level corresponding to the voltage level Vref of the output variable signal for impedance measurement of the intermediate transfer belt 10.

The transfer voltage Vout and the constant current Iout are supplied to the primary transfer roller 6.

The impedance measurement circuit 92 detects a voltage Vrb generated between the primary transfer roller 6 and the intermediate transfer belt 10 when the constant current Iout flows from the primary transfer roller 6 to the intermediate transfer belt 10, and measures an impedance Zb of the intermediate transfer belt 10 based on the constant current Iout and the voltage Vrb. The measurement result of the impedance measurement circuit 92 is supplied to the print controller 40.

The print controller 40 includes one output table stored in an internal memory, determines the level of the transfer voltage Vout by checking the measurement result of the impedance measurement circuit 92 against the output table, and controls the voltage level Vref of the output variable signal according to the determined level.

Figure 4:
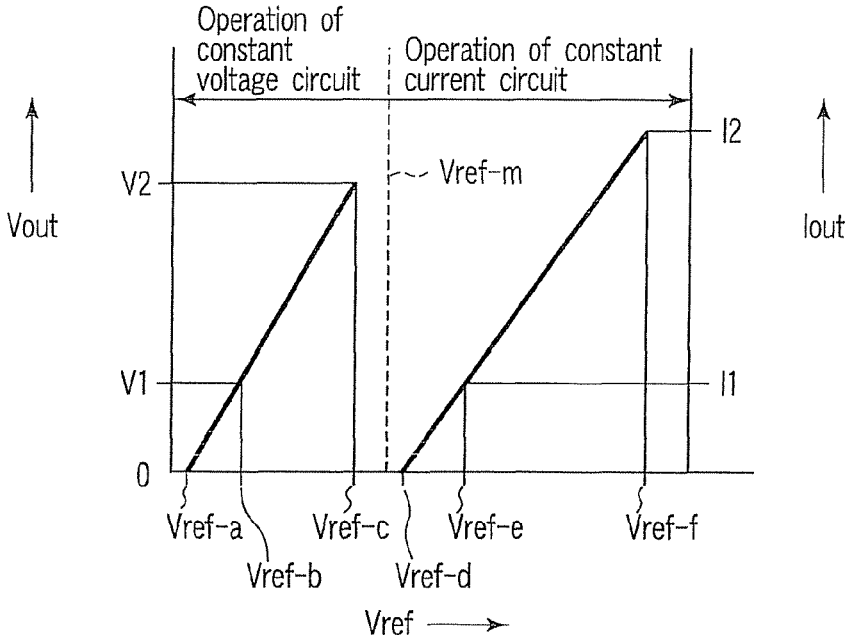
FIG. 4 is a view showing output characteristics of the power supply unit of the embodiment.

Next, the operation will be described with reference to FIG. 4.

Before transfer by the primary transfer roller 6, the voltage level Vref of the output variable signal outputted from the signal generation circuit 91 is set to the reference level Vref−m or higher. Then, the determination result of the level determination circuit 60 becomes affirmative. By this, the constant current output circuit 80 operates, and the constant current Iout for impedance measurement is outputted from the constant current output circuit 80. As the voltage level Vref of the output variable signal becomes high, the level of the constant current Iout becomes high. That is, when the voltage level Vref of the output variable signal is set to Vref−e, the level of the constant current Iout becomes I1. When the voltage level Vref of the output variable signal is set to Vref−f (>Vref−e), the level of the constant current Iout becomes I2 (>I1).

The constant current Iout flows from the primary transfer roller 6 to the intermediate transfer belt 10. At this time, the impedance Zb of the intermediate transfer belt 10 is measured by the impedance measurement circuit 92. This measurement result is supplied to the print controller 40.

The print controller 40 checks the measurement result of the impedance measurement circuit 92 against the output table stored in the internal memory, and determines the level of the transfer voltage Vout of the primary transfer roller 6.

At the time of the transfer by the primary transfer roller 6, the voltage level Vref of the output variable signal outputted from the signal generation circuit 91 is set to be lower than the reference level Vref−m. Then, the determination result of the level determination circuit 60 becomes negative. At this time, the constant voltage output circuit 70 operates, and the transfer voltage Vout is outputted from the constant voltage output circuit 70.

In this case, the level of the transfer voltage Vout is previously determined by the print controller 40, and the voltage level Vref (<Vref−m) of the output variable signal is set so that the determined transfer voltage Vout is obtained. That is, when the voltage level Vref of the output variable signal is set to Vref−b, the level of the transfer voltage Vout becomes V1. When the voltage level Vref of the output variable signal is set to Vref−c (>Vref−b), the level of the transfer voltage Vout becomes V2 (>V1).

Accordingly, even if the impedance Zb of the intermediate transfer belt 10 is changed by the influence of an environmental change, deterioration with age or the like, irrespective of the change, the stable constant voltage most suitable for transfer of the primary transfer roller 6 is applied to the primary transfer roller 6.

Especially, the voltage output and current output of the power supply unit 50 can be appropriately controlled by only one output variable signal. By this, the number of signal lines can be reduced to one, and the number of output tables can be reduced to one. Thus, the simplification of the circuit and cost reduction can be achieved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a process unit including an image bearing body; and at least one power supply unit configured to output a voltage and a current required for an operation of the process unit, wherein the power supply unit includes a level determination circuit to determine whether a voltage level of an output variable signal inputted from outside is a previously set reference level or higher, and a constant voltage output circuit and a constant current output circuit selectively operating according to a determination result of the level determination circuit, the constant voltage output circuit operates in a case where the determination result of the level determination circuit is negative, and outputs the voltage of a level corresponding to the voltage level of the output variable signal, and the constant current output circuit operates in a case where the determination result of the level determination circuit is affirmative, and outputs the current of a level corresponding to the voltage level of the output variable signal.

2. The apparatus according to claim 1, wherein the image bearing body is a photoconductive drum and an intermediate transfer belt rotating while coming in contact with the photoconductive drum.

3. The apparatus according to claim 2, wherein the process unit includes:

a charging unit configured to charge a surface of the photoconductive drum;

a laser unit configured to expose the surface of the photoconductive drum charged by the charging unit to a laser beam and to form an electrostatic latent image on the surface of the photoconductive drum;

a development unit configured to supply a toner to the surface of the photoconductive drum and to develop the electrostatic latent image on the surface of the photoconductive drum into a visible image;

a primary transfer roller configured to transfer the visible image on the photoconductive drum to the intermediate transfer belt; and a secondary transfer roller configured to transfer the visible image on the intermediate transfer belt to a paper sheet.

4. The apparatus according to claim 3, wherein the power supply unit outputs a transfer voltage required for transfer by the primary transfer roller, and outputs a constant current for measurement of an impedance of the intermediate transfer belt before transfer by the primary transfer roller.

5. The apparatus according to claim 4, further comprising:

an impedance measurement circuit configured to measure the impedance of the intermediate transfer belt based on the constant current outputted from the power supply unit; and a controller configured to determine a level of the transfer voltage according to the impedance measured by the impedance measurement circuit and to control the voltage level of the output variable signal according to the determined level.

6. The apparatus according to claim 3, further comprising a fixing unit configured to fix the visible image transferred on the paper sheet.

7. The apparatus according to claim 2, wherein the process unit includes:

a charging unit configured to charge a surface of the photoconductive drum;

a laser unit configured to expose the surface of the photoconductive drum charged by the charging unit to a laser beam and to form an electrostatic latent image on the surface of the photoconductive drum;

a black development unit configured to supply a black toner to the surface of the photoconductive drum and to develop the electrostatic latent image on the surface of the photoconductive drum into a black visible image;

a color development unit configured to supply toners of a plurality of colors to the surface of the photoconductive drum and to develop the electrostatic latent image on the surface of the photoconductive drum into a visible image of the plurality of colors;

a primary transfer roller configured to transfer the visible image on the photoconductive drum to the intermediate transfer belt; and a secondary transfer roller configured to transfer the visible image on the intermediate transfer belt to a paper sheet.

8. The apparatus according to claim 7, wherein the power supply unit outputs a transfer voltage required for transfer by the primary transfer roller and a constant current for measurement of an impedance of the intermediate transfer belt before transfer by the primary transfer roller.

9. The apparatus according to claim 8, further comprising:

an impedance measurement circuit configured to measure the impedance of the intermediate transfer belt based on the constant current outputted from the power supply unit; and a controller configured to determine a level of the transfer voltage according to the impedance measured by the impedance measurement circuit and to control the voltage level of the output variable signal according to the determined level.

10. An image forming apparatus comprising:

process means including image bearing means; and at least one power supply means for outputting a voltage and a current required for an operation of the process means, wherein the power supply means includes level determination means for determining whether a voltage level of an output variable signal inputted from outside is a previously set reference level or higher, and constant voltage output means and constant current output means selectively operating according to a determination result of the level determination means, the constant voltage output means operates in a case where the determination result of the level determination means is negative, and outputs the voltage of a level corresponding to the voltage level of the output variable signal, and the constant current output means operates in a case where the determination result of the level determination means is affirmative, and outputs the current of a level corresponding to the voltage level of the output variable signal.

11. The apparatus according to claim 10, wherein the image bearing means is a photoconductive drum and an intermediate transfer belt rotating while coming in contact with the photoconductive drum.

12. The apparatus according to claim 11, wherein the process means includes:

charging means for charging a surface of the photoconductive drum;

laser means for exposing the surface of the photoconductive drum charged by the charging means to a laser beam and for forming an electrostatic latent image on the surface of the photoconductive drum;

development means for supplying a toner to the surface of the photoconductive drum and for developing the electrostatic latent image on the surface of the photoconductive drum into a visible image;

primary transfer means for transferring the visible image on the photoconductive drum to the intermediate transfer belt; and secondary transfer means for transferring the visible image on the intermediate transfer belt to a paper sheet.

13. The apparatus according to claim 12, wherein the power supply means outputs a transfer voltage required for transfer by the primary transfer means, and outputs a constant current for measurement of an impedance of the intermediate transfer belt before transfer by the primary transfer means.

14. The apparatus according to claim 13, further comprising:

impedance measurement means for measuring the impedance of the intermediate transfer belt based on the constant current outputted from the power supply means; and control means for determining a level of the transfer voltage according to the impedance measured by the impedance measurement means and for controlling the voltage level of the output variable signal according to the determined level.

15. The apparatus according to claim 12, further comprising fixing means for fixing the visible image transferred on the paper sheet.

16. The apparatus according to claim 11, wherein the process means includes:

charging means for charging a surface of the photoconductive drum;

laser means for exposing the surface of the photoconductive drum charged by the charging means to a laser beam and for forming an electrostatic latent image on the surface of the photoconductive drum;

black development means for supplying a black toner to the surface of the photoconductive drum and for developing the electrostatic latent image on the surface of the photoconductive drum into a black visible image;

color development means for supplying toners of a plurality of colors to the surface of the photoconductive drum and for developing the electrostatic latent image on the surface of the photoconductive drum into a visible image of the plurality of colors;

primary transfer means for transferring the visible image on the photoconductive drum to the intermediate transfer belt; and secondary transfer means for transferring the visible image on the intermediate transfer belt to a paper sheet.

17. The apparatus according to claim 16 wherein the power supply means outputs a transfer voltage required for transfer by the primary transfer means and a constant current for measurement of an impedance of the intermediate transfer belt before transfer by the primary transfer means.

18. The apparatus according to claim 17, further comprising:

impedance measurement means for measuring the impedance of the intermediate transfer belt based on the constant current outputted from the power supply means; and control means for determining a level of the transfer voltage according to the impedance measured by the impedance measurement means and for controlling the voltage level of the output variable signal according to the determined level.

* * * * *